US007454346B1

(12) United States Patent
Dodrill et al.

(10) Patent No.: US 7,454,346 B1
(45) Date of Patent: Nov. 18, 2008

(54) APPARATUS AND METHODS FOR CONVERTING TEXTUAL INFORMATION TO AUDIO-BASED OUTPUT

(75) Inventors: Lewis D. Dodrill, Richmond, VA (US); Ryan A. Danner, Glen Allen, VA (US); Steven J. Martin, Richmond, VA (US)

(73) Assignee: Cisco Technology, Inc., San Jose, CA (US)

( * ) Notice: Subject to any disclaimer, the term of this patent is extended or adjusted under 35 U.S.C. 154(b) by 566 days.

(21) Appl. No.: 09/679,109

(22) Filed: Oct. 4, 2000

(51) Int. Cl.
*G10L 13/08* (2006.01)

(52) U.S. Cl. ..... 704/260; 704/258; 704/270

(58) Field of Classification Search ..... 704/270, 704/275, 270.1, 258–269, 260; 455/563
See application file for complete search history.

(56) References Cited

U.S. PATENT DOCUMENTS

| | | | | |
|---|---|---|---|---|
| 4,837,798 | A | 6/1989 | Cohen et al. | 379/88 |
| 5,915,001 | A * | 6/1999 | Uppaluru | 379/88.22 |
| 6,088,675 | A * | 7/2000 | MacKenty et al. | 704/270 |
| 6,141,642 | A * | 10/2000 | Oh | 704/260 |
| 6,240,391 | B1 * | 5/2001 | Ball et al. | 704/270 |
| 6,269,336 | B1 * | 7/2001 | Ladd et al. | 704/270 |
| 6,516,207 | B1 * | 2/2003 | Gupta et al. | 455/563 |
| 6,557,026 | B1 * | 4/2003 | Stephens, Jr. | 709/203 |
| 6,604,077 | B2 * | 8/2003 | Dragosh et al. | 704/270.1 |
| 6,658,389 | B1 * | 12/2003 | Alpdemir | 704/275 |
| 2001/0047260 | A1 * | 11/2001 | Walker et al. | 704/260 |
| 2001/0049602 | A1 * | 12/2001 | Walker et al. | 704/260 |
| 2002/0052747 | A1 * | 5/2002 | Sarukkai | 704/270 |

OTHER PUBLICATIONS

The University of Edinburgh; "The Festival Speech Synthesis System"; 2 Pages; http://www.cstr.ed.ac.uk/projects/festival/.
John Cox; Apr. 24, 2000; Network World Fusion News; "Allowing the Web to be heard"; 5 Pages; http://www.nwfusion.com/news/2000/0424apps.html?nf.

* cited by examiner

*Primary Examiner*—Richemond Dorvil
*Assistant Examiner*—Qi Han
(74) *Attorney, Agent, or Firm*—Kraguljac & Kalnay, LLC

(57) ABSTRACT

A system for providing text-to-speech conversion of a body of text is presented. The system includes a first executable resource which generates text portions from the body of text in response to receiving an initial web request to convert the body of text to speech and provides an output in response to generating the text portions comprising a sequence of resource identifiers suitable for use in the text-to-speech conversion of the text portions. The system further includes a second executable resource which receives a text portion web request that requests the conversion of at least one text portion to an audio format, the text portion web request comprising the at least one text portion and one of the resource identifiers, and further provides at least one media file suitable for audio output based on the text portion web request.

4 Claims, 6 Drawing Sheets

APPARATUS AND METHODS FOR CONVERTING TEXTUAL INFORMATION TO AUDIO-BASED OUTPUT

BACKGROUND OF THE INVENTION

Historically, a computer can provide the ability to convert text passages to an audio output for a user. Typically, a user sitting at a computer requests the conversion of text to an audio output (e.g. text to speech). Then the computer executes text-to-speech (TTS) software that converts the text to the audio output, which the computer then plays through a speaker for the user to hear. The user may be an individual who is visually impaired who uses the TTS software to hear text displayed on the computer screen, a user accessing a computer system from an audio communication device (such as a telephone), or a user of a computer who prefers to hear speech output rather than reading text on the computer's visual display.

In one conventional approach to TTS conversion, the user of a client computer or telephone may request the conversion of text to speech over a remote or network connection to a remote computer (e.g. server) that is executing the TTS software. For example, if the user is using a telephone, the user may make a request for a stock report from the remote computer, which accesses the text for the stock report from a database and converts the text to audio-based output. The remote computer then sends the audio-based output to the audio telephone to be output through the speaker of the device. In another example, if the user is using a client computer, the TTS software on a remote computer typically converts the body of text to an audio-based output, such as an output file having an audio file format. One commonly used audio output file format is the WAV audio file format for storing sounds as waveforms, which specifies a ".wav" file extension, such as typically used by the Microsoft® Windows® operating system. The server then sends the audio file back to the client computer, which plays the audio file for the user, who hears the file through the speaker of the client computer.

In another example of a conventional approach, the client computer and server computers can be connected through the World Wide Web (WWW), which provides communication over a network using the Internet Protocol (IP) and transmits requests over the network based on the hypertext transport protocol (HTTP). Users sitting at a client computer can thus make HTTP requests to a server located on the web, which provides information and services to the user at the client computer. Typically, the user invokes a web browser at the client computer and makes the request to the web browser, which in turn makes the HTTP request over the WWW to a server to fulfill the request. Thus, the user can initiate an HTTP request to hear textual information over the WWW to a server that includes TTS software. The server receives the HTTP request and executes TTS software on the server to convert the textual information to an audio format, such as a WAV file. The TTS server returns the audio output file to the client computer, which then plays the audio output file through the client's speaker for the user.

One example of TTS software is the Festival Speech Synthesis System, which is a TTS application that can execute on a server to provide text-to-speech conversion. The Festival Speech Synthesis System is available from the Centre for Speech Technology Research (CSTR), University of Edinburgh, Edinburgh, United Kingdom.

SUMMARY OF THE INVENTION

In a conventional approach, such as the approaches described above, a TTS server receives the request over the network for the TTS conversion and converts the entire body of text into one audio output file. Typically, this conversion process is computation intensive and takes sufficient time such that the user of a client computer or non-visual device (e.g. telephone) may notice a delay before hearing the beginning of the audio output file. For the conversion of large bodies of text, the delay can be noticeable, such as a delay of seconds or minutes.

In one example of a conventional approach, suppose that a user of a non-visual device, such as a telephone, requests an audio output based on textual information using the telephone. The request is handled by a remote computer having TTS software, which is in communication with the non-visual device. As described above, a user may experience a substantial delay before beginning to hear the audio output representing the textual information due to the lengthy conversion process at the remote computer.

Conversely, the invention is directed to an improved approach for providing TTS services over a network, such as for users of telephones who are accessing textual information over a web (such as the WWW). Part of the approach of the invention is to divide the body of textual information to be converted into speech into text portions that can be converted into speech in a relatively brief amount of time. In one embodiment of the invention, an application server receives the request for the conversion of the textual information and divides the body of textual information into the text portions. For example, suppose that a user of a telephone requests access to textual information by telephone, and passes this request to an intermediary device (e.g. a proxy browser) that serves as an intermediary between the telephone and the web. The proxy browser passes the request (e.g. an HTTP request) to a web application executing on the application server. The web application determines the body of text to be converted, such as by locating the text in a database or over the web. The web application then divides the text into text portions. The web application also locates or determines a TTS server that is available and can handle the TTS conversion. The web application then sends back to the proxy browser a sequence of resource identifiers, such as Uniform Resource Locators (URL's). Each resource identifier includes a text portion and the identity of the TTS server. The sequence of the resource identifiers corresponds to the respective positions of the text portions in the body of text. The proxy browser can then make HTTP requests using the URL's to convert the text portions specified therein in a sequence that reflects the respective positions of the text portions in the body of text. The TTS server receives the requests, performs the conversions of the text portions, and provides back audio output files to the proxy browser. The proxy browser can then play back the audio output files over a connection to the telephone. Because the proxy browser makes the text portion web requests in sequence, then the user hears the body of text, for example over the telephone, in a substantially continuous manner as though the TTS server had converted the body of text as a whole into one audio file that the proxy browser plays for the user.

In another example of the invention, a user who is sitting at a client computer that does not have TTS software available on it, uses a web browser on the client computer to access a web application performing on an application server, and desires to have textual information converted to speech. The textual information may be initially passed from the browser to the web application in its entirety. Alternatively, the textual information originates from or is stored in a database accessed by the web application, or otherwise obtained by the web application (e.g. over the web). In any event, the web application divides the textual information into text portions and returns resource identifiers, such URL's, including respective text portions, to the client, as described above for the user of a telephone accessing a web application. The client's browser can then make HTTP requests using the resource identifiers to a TTS server identified in the resource identifiers. The TTS server converts each text portion and returns an audio output file to the client representing each text portion. The client computer can then play each audio output file to the user over the speaker of the client computer.

In one embodiment, the invention is directed to a system for providing text-to-speech conversion of a body of text. The system includes a first executable resource and a second executable resource. For example, the first executable resource can be a web application on one server computer that handles the initial request for the conversion of textual information to speech, and the second executable resource can be a TTS application on a different server computer than performs the conversion. The first executable resource generates text portions from the body of text in response to receiving an initial web request to convert the body of text to speech, and provides an output in response to generating the text portions. The output includes a sequence of resource identifiers suitable for use in the text-to-speech conversion of the text portions. Each of the resource identifiers includes a corresponding one of the text portions and an identity of a resource capable of performing the text-to-speech conversion. The second executable resource receives a text portion web request that requests the conversion of one or more text portions to an audio format. The text portion web request includes the text portion and one of the resource identifiers. The second executable resource provides one or more media files suitable for audio output in response to receiving the text portion web request. Thus, for example, a requester, such as a user of a client device, can hear the media files which represent the body of text that the first executable resource (e.g. web application) had previously divided into text portions.

In another embodiment, the first executable resource generates the text portions in response to receiving an initial hypertext transport protocol (HTTP) request to convert the body of text to speech and provides a hypertext markup language (HTML) page including uniform resource locators (URL's) that includes text character strings suitable for conversion to the audio format. The identity of the resource includes an HTTP address of the resource. The second executable resource receives one or more HTTP requests including one or more URL's in response to providing the output. For example, a user can access the system from a local computer or client device, and then the system can perform the conversion from text to speech for the user over the web without requiring that any TTS software be installed on the local computer or client device.

In one embodiment, the invention is directed to a method for providing text-to-speech conversion of a body of text. The method includes generating text portions from the body of text in response to receiving an initial web request to convert the body of text to speech, and providing an output in response to generating the text portions. The output includes a sequence of resource identifiers suitable for use in the text-to-speech conversion of the text portions. Each of the resource identifiers includes a corresponding one of the text portions and an identity of a resource capable of performing the text-to-speech conversion. The method further includes receiving a text portion web request that requests the conversion of one or more text portions to an audio format. The text portion web request includes the text portion and one of the resource identifiers in response to providing the output. The method additionally includes providing one or more media files suitable for audio output in response to receiving the text portion web request. Thus, for example, the method provides output media files to a client device to play to a user, so that the user hears an audio version of the body of text based on the text portions without the delay caused in conventional systems by waiting for the TTS conversion of one relatively large, undivided body of text to one media file.

Another embodiment of the method of the invention includes generating text portions in response to receiving an initial HTTP request to convert the body of text to speech, and providing an HTML page comprising URL's that include text character strings suitable for conversion to the audio format. The identity of the resource includes an HTTP address of the resource. The method further includes receiving one or more HTTP requests that include one or more of the URL's in response to providing the output. The method provides for the conversion of the text portions representing the body of text over the web using HTTP protocols. Thus, a user who has access to the web can request the TTS conversion of text over the web.

In one embodiment, the invention is directed to a server for providing text-to-audio resource information. The server includes a network interface and an executable resource. The executable resource generates text portions from a body of text, formats resource identifiers suitable for use in text-to-audio conversion of the text portions, and provides, through the network interface, an output comprising the resource identifiers in response to formatting the resource identifiers. Each of the resource identifiers includes a corresponding one of the text portions and an identity of a resource capable of performing the text-to-audio conversion.

In another embodiment, the resource identifiers are URL's having text portions that include character strings suitable for conversion to an audio format. The identity of the resource is an HTTP address of the resource. In a further embodiment, the executable resource provides the resource identifiers in a prescribed sequence based on respective positions of the text portions in the body of text. For example, the executable resource (e.g. a web application) divides the body of text into smaller portions that are more readily converted to speech and identifies a TTS resource (e.g. a TTS application) that is capable of performing the TTS conversion of the text portions in the prescribed sequence. Thus, after the TTS conversion, a listener hears a speech version of the body of text as though converted in one step, and the conversion occurs more quickly than would occur in a conventional system that converts the body of text as a whole.

In one embodiment, the invention is directed to a method in a server for providing text-to-audio resource information. The method includes generating text portions from a body of text, formatting resource identifiers suitable for use in text-to-audio conversion of the text portions, and providing an output that includes the resource identifiers in response to formatting the resource identifiers. Each of the resource identifiers includes a corresponding one of the text portions and an identity of a resource capable of performing the text-to-audio conversion. In another embodiment, the method includes receiving an initial request for a text-to-audio conversion of the body of text, and generating the text portions in response to receiving the initial request. Thus, the body of text is divided into text portions in response to an initial request that can be converted to audio more readily than the conversion of the body of text as a whole, as would be done in a conventional system.

In an additional embodiment, the method includes generating each text portion in a manner suitable for inclusion in an HTTP request. Another embodiment of the invention includes providing the resource identifiers in the form of URL's having text portions that include character strings suitable for conversion to an audio format. The identity of the resource includes an HTTP address of the resource. In another embodiment, the method includes providing the resource identifiers in a prescribed sequence based on respective positions of the text portions in the body of text. For example, the executable resource (e.g. web application) divides the body of text into smaller portions that are more readily converted to speech and identifies a TTS resource (e.g. TTS application) that is capable of performing the TTS conversion of the text portions in the prescribed sequence. Thus, after the conversion, a listener hears a speech version of the body of text as though converted in one step, but more quickly than would occur for converting the body of text as a whole as would be done using a conventional system.

In one embodiment, the invention is directed to a server for providing text-to-audio resource information. The server includes a network interface and a means for producing resource identifiers. The producing means generates text portions from a body of text, formats resource identifiers suitable for use in text-to-audio conversion of the text portions, and provides, through the network interface, an output comprising the resource identifiers in response to the step of formatting the resource identifiers. Each of the resource identifiers includes a corresponding one of the text portions and an identity of a resource capable of performing text-to-audio conversion. In another embodiment, the resource identifiers are URL's having text portions that include character strings suitable for conversion to an audio format, and the identity of the resource is an HTTP address of the resource.

In one embodiment, the invention is directed to a computer program product that includes a computer readable medium having instructions stored thereon for providing text-to-audio resource information. The instructions, when carried out by a computer, cause the computer to perform any or all of the operations disclosed herein of the invention. For example, the instructions cause the computer to generate text portions from a body of text, format resource identifiers suitable for use in text-to-audio conversion of the text portions, and provide an output comprising the resource identifiers in response to formatting the resource identifiers. Each of the resource identifiers includes a corresponding one of the text portions and an identity of a resource capable of performing the text-to-audio conversion.

In one embodiment, the invention is directed to a text-to-audio server for providing text-to-audio conversion of a body of text. The text-to-audio server includes a network interface and an executable resource. The executable resource receives, through the network interface, a text portion web request that requests a conversion to an audio format of one or more text portions generated from a body of text and generates a response suitable for audio output in response to receiving the text portion web request. The text portion web request includes one or more text portions and the identity of a resource capable of text-to-audio conversion. In another embodiment, the text portion web request includes a URL that includes character strings suitable for conversion to an audio format, and the identity of the resource comprises an HTTP address of the resource. In a further embodiment, the response includes media files suitable for the audio output. Thus, a requester (e.g. client device or intermediary computer) of the TTS conversion of a body of text can make and fulfill requests for a text portion to be converted to a media file in a relatively quick manner for each text portion compared to the time needed to convert the whole body of text to speech in one step, and make additional requests for each text portion until the conversion of the body of text is complete. As the conversion occurs for each media file, then a user (e.g. of a client device) hears the media file for each text portion as soon as each text portion has been converted.

In one embodiment, the invention is directed to a method in a text-to-audio server for providing text-to-audio conversion of a body of text. The method includes receiving a text portion web request that requests a conversion to an audio format of one or more text portions generated from a body of text, and generating a response suitable for audio output in response to receiving the text portion web request. The text portion web request includes one or more text portions and the identity of a resource capable of text-to-audio conversion. In another embodiment, the method includes receiving a URL that includes character strings suitable for conversion to an audio format, and the identity of the resource includes an HTTP address of the resource. In an additional embodiment, the method includes generating media files suitable for the audio output. Thus, as noted above, a requester (e.g. a client device or intermediary computer) of the TTS conversion of a body of text can make and fulfill requests for a text portion to be converted to a media file in a relatively quick manner for each text portion compared to the time needed to convert the whole body of text to speech in one step, and make additional requests for each text portion until the conversion of the body of text is complete. As the conversion occurs for each media file, then a user (e.g. of a client device) hears the media file for each text portion as soon as each one has been converted.

In another embodiment, the invention is directed to a text-to-audio server for providing text-to-audio conversion of a body of text. The text-to-audio server includes a network interface and means for converting text to audio. The converting means receives through the network interface a text portion web request that requests the conversion to an audio format of one or more text portions generated from a body of text, and generates a response suitable for audio output in response to receiving the text portion web request. The text portion web request includes the text portion and the identity of a resource capable of text-to-audio conversion. In a further embodiment, the text portion web request includes a URL that includes character strings suitable for conversion to the audio format, and the identity of the resource includes an HTTP address of the resource.

In a further embodiment, the invention is directed to a computer program product that includes a computer readable medium having instructions stored thereon for providing text-to-audio conversion of a body of text. The instructions, when carried out by a computer, cause the computer to perform any or all of the operations disclosed herein of the invention. For example, the instructions cause the computer to receive a text portion web request that requests the conversion to an audio format of one or more text portions generated from a body of text, and generates a response suitable for audio output in response to receiving the text portion web request. The text portion web request includes one or more text portions and the identity of a resource that is capable of text-to-audio conversion.

In one embodiment, the invention is directed to a method in a browser for providing text-to-speech conversion of a body of text. The method includes requesting conversion of the body of text to speech, receiving a prescribed sequence of resource identifiers including respective text portions generated sequentially from the body of text, providing the resource identifiers in the prescribed sequence to the resource, and providing audio-based output according to the prescribed sequence, based on media files received from the resource in response to providing the resource identifiers. The media files represent the respective text portions. Each of the resource identifiers includes one of the respective text portions and an identity of a resource capable of performing the text-to-speech conversion.

In another embodiment, the method includes receiving an HTML page that includes URL's that include text character strings suitable for conversion to an audio format. The method further includes providing HTTP requests to a resource. The identity of the resource includes an HTTP address of the resource. For example, a proxy browser may be in communication with a client device, such as a cell phone or device without its own browser. In response to a request from the client device, the proxy browser can request the conversion of text to speech using HTTP protocols over the web and coordinate the playback of audio files representing the text portions through the client device.

In another embodiment, the invention is directed to a resource identifier suitable for use in requesting text-to-audio conversion over a network. The resource identifier includes a text portion generated from a body of text and an identity of a resource capable of converting the text portion to an audio format. In a further embodiment of the resource identifier, the text portion includes character strings suitable for conversion to the audio format. In an additional embodiment of the resource identifier, the identity of the resource is the HTTP address of the resource. Thus, the resource identifier provides a relatively compact way of requesting the conversion of a piece of text (i.e. a text portion) using a low overhead format for the request, such as an HTTP request.

In one embodiment, the invention is directed to a computer data propagated signal embodied in a propagated medium, having a packet of data comprising a hypertext transport protocol (HTTP) request, which includes a text portion generated from a body of text and an identity of a resource capable of converting the text portion to an audio format. Thus, a computer receiving the propagated signal can convert the text portion received over the propagated medium to audio by making a request for the conversion to the identified resource.

In some embodiments, the techniques of the invention are implemented primarily by computer software. The computer program logic embodiments, which are essentially software, when executed on one or more hardware processors in one or more hardware computing systems cause the processors to perform the techniques outlined above. In other words, these embodiments of the invention are generally manufactured as a computer program stored on a disk, memory, card, or other such media that can be loaded directly into a computer, or downloaded over a network into a computer, to make the device perform according to the operations of the invention. In one embodiment, the techniques of the invention are implemented in hardware circuitry, such as an integrated circuit (IC) or application specific integrated circuit (ASIC).

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Figure 1:
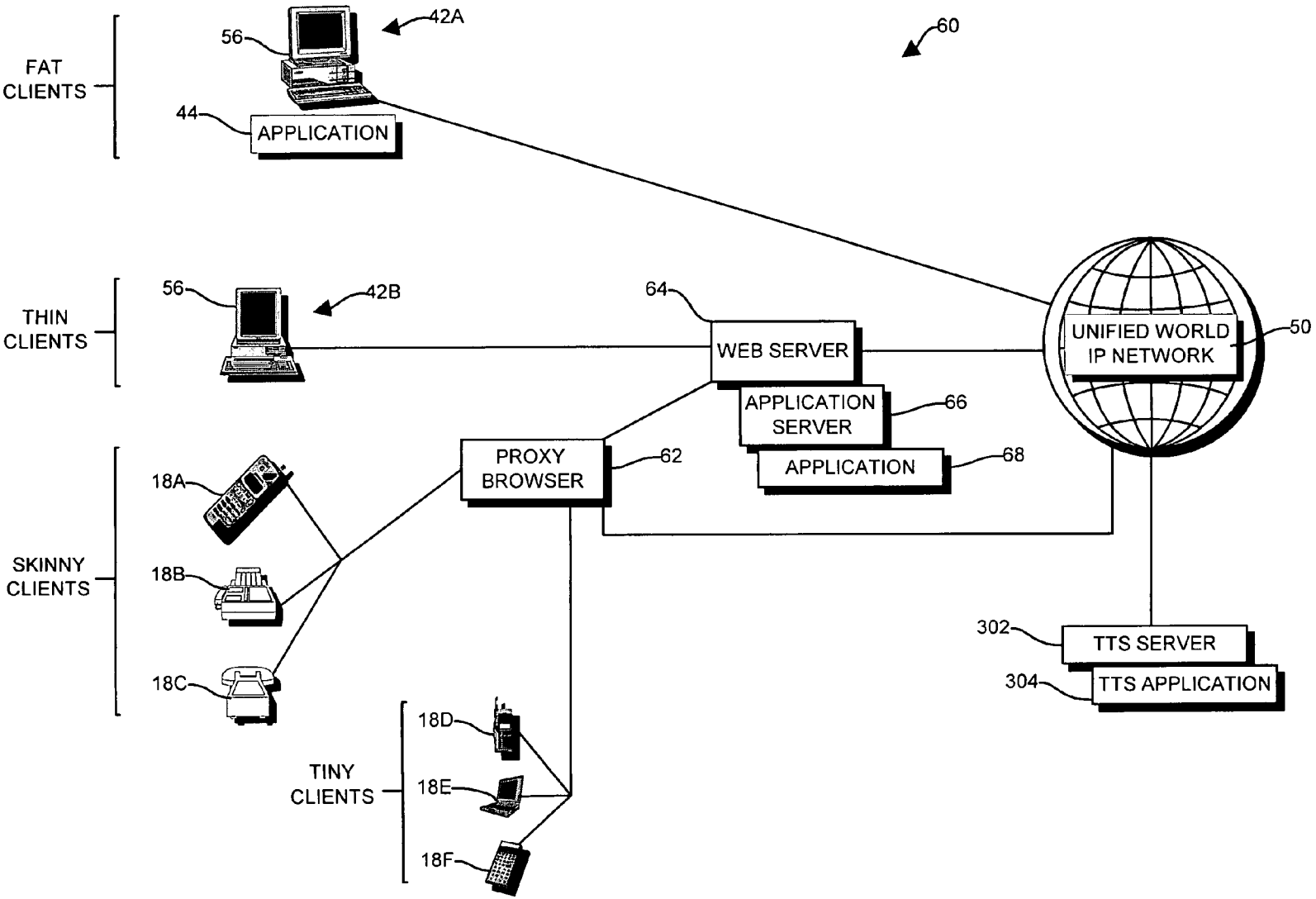
FIG. 1 is a block diagram illustrating a paradigm for providing text-to-speech (TTS) services via an IP network using a TTS server according to an embodiment of the present invention.

The invention is directed to techniques for providing TTS services over a network, such as the Internet, to a user of a device, such as a client computer or non-visual device (e.g. telephone). The user accesses textual information over a network (e.g. web), which the user desires to convert to an audio format and hear over the speaker of the client computer or non-visual device. Part of the approach of the invention is to divide a body of text to be converted into speech into text portions and to provide to the requester the text portions along with an identity of a TTS resource that can convert the text portions into speech. In one embodiment, an application server receives the request for the conversion of the text, divides the body of text into text portions, and returns these text portions in a series of resource identifiers, each including a respective text portion.

For example, in one embodiment of the invention, suppose a user of a telephone has requested access to textual information over the web by using the telephone, and passes this request to a proxy browser that serves as an intermediary between the telephone and the web. The proxy browser passes the request, (e.g. an HTTP request) to a web application executing on the application server. The web application accesses the web to locate the body of text to be converted and then divides the text into text portions. The web application also locates, such as by looking up in a table in a database, a TTS server that is available and can handle a TTS conversion of those text portions. The web application then returns to the proxy browser, or other intermediary, a sequence of resource identifiers (e.g. URL's), each resource identifier including a text portion and the identity of the TTS server. The sequence of the resource identifiers corresponds to the respective positions of the text portions in the body of text. The proxy browser can then make text portion web requests (e.g. HTTP requests) using the URL's to convert the text portions in a sequence that reflects the respective positions of the text portions in the body of text. The TTS server receives the requests in sequence from the proxy browser, performs the conversions of the text portions, and provides back audio output files to the proxy browser. For example, the proxy browser can then play back the audio output files over a connection to the telephone. Because the proxy browser makes the text portion web requests in sequence, then the user hears the body of text over the telephone in a substantially continuous manner as though the TTS server had converted the body of text as a whole into one audio file that the proxy browser plays for the user.

In another example of one approach of the invention, a user is sitting at a client computer that does not have TTS software available on it, uses a web browser on the client computer to access a web application performing on an application server, and desires to have textual information converted to speech. The web application divides the textual information into text portions and returns resource identifiers, such URL's, to the client, as described above for the user of a telephone accessing a web application. The client's browser can then make HTTP requests using the resource identifiers to a TTS server identified in the resource identifiers. The TTS server converts each text portion and returns an audio output file to the client representing each text portion. The client computer can then play each audio output file to the user over the speaker of the client computer.

Generally the approach of the invention is well suited for any client devices (e.g. computer, communication, or other type of device) that do not have TTS software performing natively on the client device. The approach of the invention also applies to client devices that do not have TTS software or a web browser resident on the client devices, in which case a proxy browser provides a connection between the client device and a web server, such as a TTS server, as will be discussed in connection with FIG. 1 below.

FIG. 1 is a diagram showing a sample approach for providing TTS services via an IP network 50 according to one embodiment of the invention. FIG. 1 illustrates client computers 42 (shown individually as 42*a* and 42*b*), a unified world IP (Internet Protocol) network 50, user client devices 18 (shown individually as clients 18*a*, 18*b*, 18*c*, 18*d*, 18*e*, and 18*f*), proxy browser 62, web server 64, application server 66, application environment 68, TTS server 302, and TTS application 304. The clients 18 include a cordless telephone 18*a*, a fax machine 18*b* having an attached telephone, an analog telephone 18*c*, a mobile phone 18*d*, a handheld computing device 18*e*, and a pager 18*f* (as described in more detail later).

In general, a client (e.g. one of 42*a*, 42*b*, 18*a*-18*f*) makes a request for a text-to-audio conversion of textual information to the application server 66 (either directly for a client computer 42 or through the proxy browser 62 for clients 18*a*-18*f*). The application server 66 divides the textual information or body of text into a sequence of text portions based on the respective positions of the text portions in the body of text. The application server 66 provides to the client computer 42 or to the proxy browser 62 a sequence of resource identifiers (e.g., Uniform Resource Locators or URL's) including the text portions and the identity (e.g., network hostname or address) of the TTS server 302. The client computer 42 or the proxy browser 62 can then use (e.g., can access or reference) the resource identifiers in a sequence of network requests (e.g., HTTP requests) corresponding to the sequence of the text portions in the text body to request from the TTS server 302 the conversion of each text portion to an audio-based output format (e.g., a WAV file). The TTS server 302 then converts the text portions in each request to audio-based output format and returns the audio-based output for each request to the client computer 42 or the proxy browser 62. The client computer 42 then plays or otherwise reproduces the audio-based output for the user through a speaker included or associated with the client computer 42. For client devices 18, the proxy browser 62 plays the audio output by providing electrical or other signals representing the audio output through a connection to the client 18 so that the user hears the audio output on a speaker that is part of or associated with the client 18. This process will be described in more detail later in connection with the flow charts illustrated in FIGS. 4, 5, and 6. The individual components illustrated in FIG. 1 will be discussed in more detail in the following paragraphs.

The web server 64 is preferably a server computer including a processor, a memory, and communication hardware that enables communication over a network, such as the IP network 50. The web server 64 provides a communication connection between the proxy browser 62 and the application server 66. In one embodiment, the web server 64 is a server providing communications over the World Wide Web.

The application server 66 is a server computer including a processor, a memory, and communication hardware that enables communication over a network, such as the IP network 50. The application server 66 also includes an executable resource or web application 68 that provides services in response to requests received over the network (e.g. HTTP requests received from the proxy browser 62).

The TTS server 302 is a server computer including a processor, a memory, and communication hardware that enables communication over a network, such as the IP network 50. The TTS server 302 includes an executable resource or TTS application 304 that provides text-to-speech conversion services in response to requests received over the network (e.g. HTTP requests). Each executable resource 68 or 304 includes one or more programs, scripts, procedures, routines, objects, and/or other software entities, capable of executing on a computing device.

The proxy browser 62 is a computing device including a processor, a memory, and communication hardware that enables communication over the IP network 50. The proxy browser 62 provides browser services over the World Wide Web for clients that have limited capabilities and which do not typically include their own web browsers. The proxy browser 62 is capable of making requests (e.g. HTTP requests) over the network to the application server 66 and the TTS server 302.

The fat client 42*a* is a computer system including a processor, a memory, an output device, such as a visual display, an input device for the customer to provide input, and communication hardware that enable communication over a network, such as the IP network 50. The fat client 42*a* includes a web browser 56 and a local application 44 running on the fat client 42*a* and providing services to the fat client 42*a*. The fat client 42*a* typically has the capacity to provide TTS software performing on the fat client 42*a*, but the user of the fat client 42*a* may not install TTS software on the fat client 42*a* and may choose to access TTS services over the IP network 50.

The thin client 42*b* is a computer system including a web browser 56. The thin client 42*b* typically does not have the capacity to provide TTS software performing on the thin client 42*b* itself and accesses the TTS services from a server over the IP network 50.

The user client devices 18*a*, 18*b*, and 18*c*, illustrated as a cordless telephone 18*a*, a fax machine 18*b* having an attached telephone, and an analog telephone 18*c*, are referred to herein as "skinny clients," defined as devices that are able to interface with a user to provide voice and/or data services (e.g., via a modem) but cannot perform any direct control of the associated access subnetwork. The wireless user client devices 18*d*, 18*e*, and 18*f*, illustrated as a mobile or cellular telephone 18*d*, a handheld computing device (e.g., a 3-Com Palm Computing or Windows CE-based handheld device) 18*e*, and a pager 18*f*, are referred to as tiny clients. "Tiny clients" tend to have even less functionality than skinny clients in providing input and output interaction with a user. The handheld computing device 18*e* and pager 18*f* may require text-to-audio conversion of textual information if the devices 18*e* and 18*f* include a speaker that can provide the audio output representing textual information to the user of the device 18*e* and 18*f*. The client devices 18*a* through 18*f* do not typically include a browser or TTS software resident or performing on them, and rely on the proxy browser 62 as an intermediary to handle text-to-audio conversion of textual information (through the application server 66 and TTS server 302 as described above).

Figure 2:
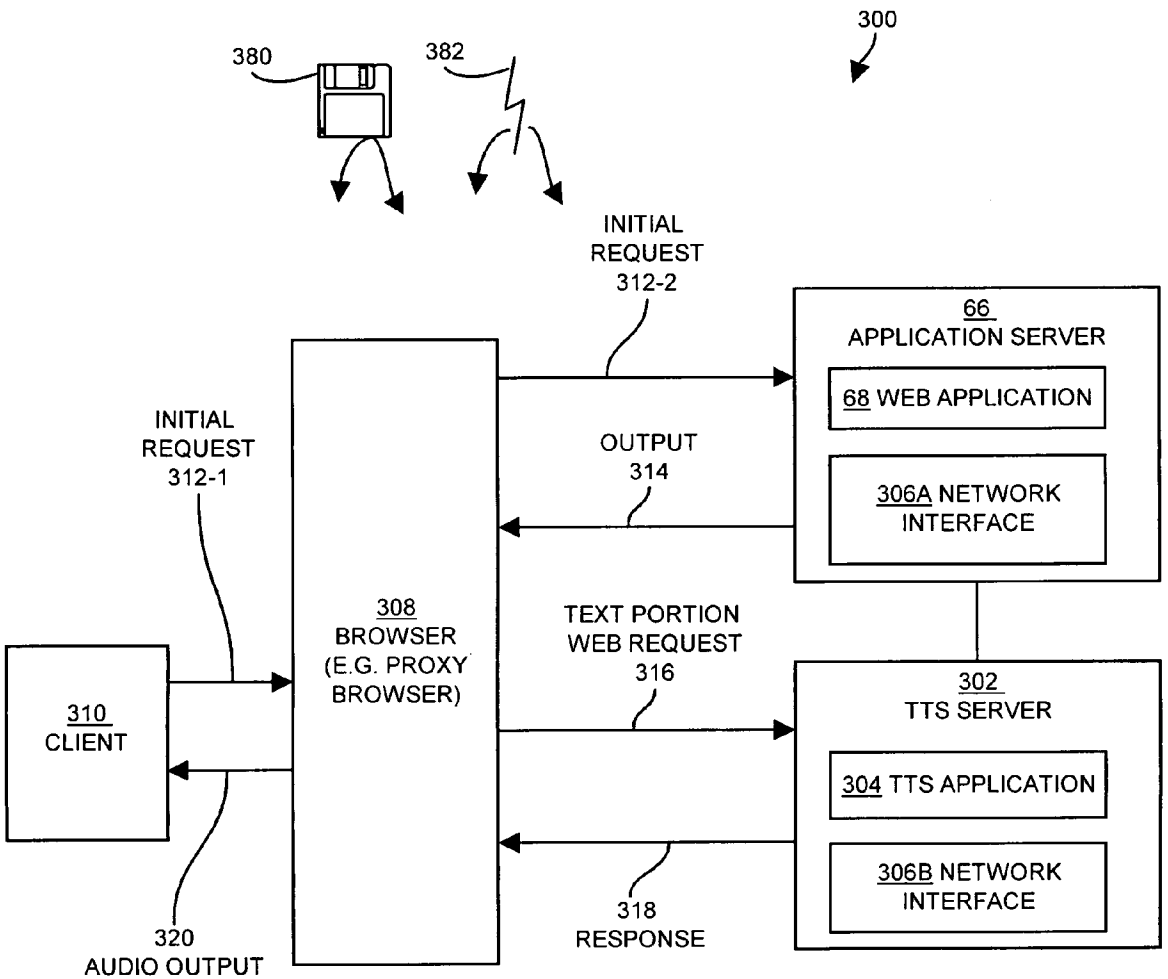
FIG. 2 is a block diagram illustrating a client, a browser, an application server, and a TTS server according to one embodiment of the invention.

FIG. 2 is a block diagram illustrating an application server 66, a TTS server 302, browser 308 (e.g. proxy browser), and client 310. Each of the components illustrated in FIG. 2 is configured to operate according to embodiments of the invention. The application server 66 includes an executable resource or web application 68, as described above, and a network interface 306*a* that provides communication to other devices, such as the TTS server 302. The TTS server 302 includes an executable resource or TTS application 304, as described above, and a network interface 306*b* that provides communication to other devices, such as the application server 66. In one embodiment, the browser 308 is a computing device that provides browsing services over a network (e.g. the World Wide Web). In another embodiment, the browser 308 is a software application or program providing browsing services over a network (such as a software browser installed and performing on a client computer or device 310). The proxy browser 62 shown in FIG. 1 is one example of a browser 308. The client 310 is a client device that does not have (or does not choose to use) TTS services available on the client 310. The client 310 can be one of the clients 42*a*, 42*b*, 18*a*-18*f* shown in FIG. 1. The client 310 also includes other computing or communication devices that may require TTS services, and are able to access the application server 66 and TTS server 302. For example, the client 310 can be an IP telephony device in communication with a browser 62 or client 42*a* or 42*b*.

In one embodiment, a computer program product 380 including a computer readable medium (e.g. one or more CDROM's, diskettes, tapes, etc.) provides software instructions for the browser 308, web application 68, and/or TTS application 304. The computer program product 380 can be installed by any suitable software installation procedure, as is well known in the art. In another embodiment, the software instructions can also be downloaded over a wireless connection. A computer program propagated signal product 382 embodied on a propagated signal on a propagation medium (e.g. a radio wave, an infrared wave, a laser wave, sound wave, or an electrical wave propagated over the Internet or other network) provides software instructions for the browser 308, web application 68, and/or TTS application 304. In alternate embodiments, the propagated signal is an analog carrier wave or a digital signal carried on the propagated medium. For example, the propagated signal can be a digitized signal propagated over the Internet or other network. In one embodiment, the propagated signal is a signal that is transmitted over the propagation medium over a period of time, such as the instructions for a software application sent in packets over a network over a period of seconds, minutes, or longer. In another embodiment, the computer readable medium of the computer program product 380 is a propagation medium that the computer can receive and read, such as by receiving the propagation medium and identifying a propagated signal embodied in the propagation medium, as described above for the computer program propagated signal product 382

Figure 3:
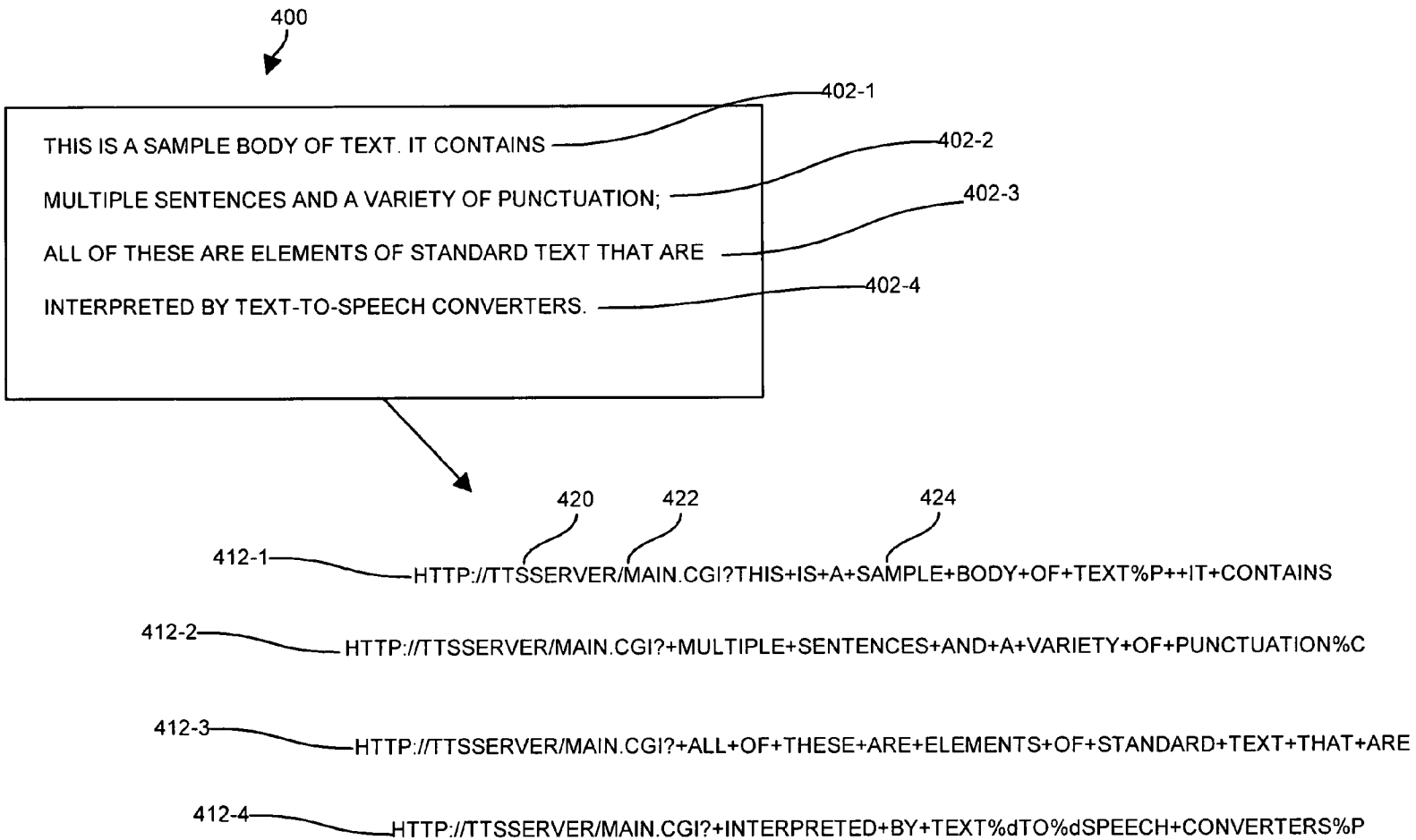
FIG. 3 is a diagram illustrating a sample body of text and Uniform Resource Locators (URL's) including portions of text generated according to one embodiment of the invention.

FIG. 3 illustrates a sample body of text 400 to be converted to speech, and resource identifiers 412 (e.g. URL's) including portions of text generated based on conversion of the body of text 400 to the text portions 402 according to one embodiment of the invention. The text-to-speech conversion process will be described in connection with the flow charts illustrated in FIGS. 4, 5, and 6. The sample body of text 400 includes, by way of example only, four lines or portions of text, referred to generally as text portions 402. After the conversion process of the invention, the four text portions 402-1, 402-2, 402-3, and 402-4 correspond to four URL's 412-1, 412-2, 412-3, and 412-4, which include reformatted versions of the respective text portions 402-1, 402-2, 402-3, and 402-4. URL 412-1 includes text portion 402-1; URL 412-2 includes text portion 402-2; URL 412-3 includes text portion 402-3; and URL 412-4 includes text portion 402-4. URL 412-1 shows, by way of example only, one arrangement of the resource identifier 412. The first part 420 of the URL 412-1 includes the HTTP address (e.g., a hostname in this example) of a text-to-speech server, referred to here as "TTSSERVER". The second part 422 of the URL 412-1 includes the name of a script, referred to here as "MAIN.CGI" used to perform the TTS conversion. In one embodiment, the script 422 corresponds to an application 68 executing on the application server 66. The third part of the URL 412-1 includes a portion of text 424, formatted so that it can be included in the URL 412-1 and corresponding to the first portion of text 402-1 in the sample body of text 400.

Figure 4:
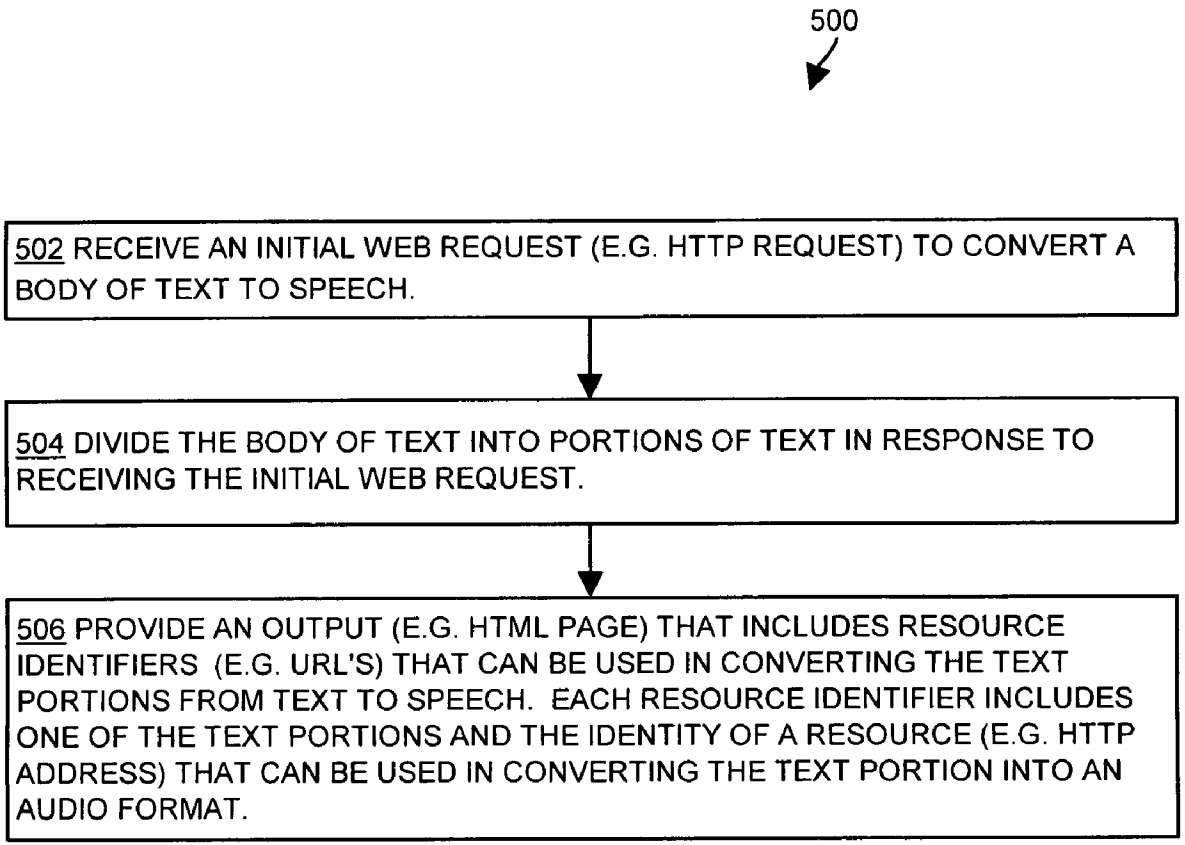
FIG. 4 is a flow chart of the process of providing resource identifiers (e.g., URL's) generated from a body of text according to one embodiment of the invention.

FIG. 4 is a flow chart of the process 500 of providing resource identifiers (e.g. URL's) generated from a body of text 400 according to one embodiment of the invention. In step 502, a browser 308 receives an initial request 312-1 (see FIG. 2) to convert a body of text 400 to speech. For example, the browser 308 initially receives the body of text 400 from a client 310 or receives the body of text 400 as the result of service or information requested by the client 310 of the browser 308 in an initial request 312-1 from the client 310 to the browser 308 (see FIG. 2). Then, the browser 308 provides a body of text 400 in a request (e.g. HTTP FORM POST request) 312-2 to the application server 66.

In another example, a client 310 makes an initial request 312-1 to a browser 308 for information or a service, such as a stock report describing an analysis of a stock that is to be returned to the client 310 as audio-based output to be played through a speaker included or associated with the client device 310. The browser 308 passes on the request 312-1 from the client 310 as a request 312-2 to the application server 66 (see FIG. 2). The web application 68 retrieves textual information as a result of the request 312-2, for example, from a local database of stock reports or by accessing a stock report service over the web.

In step 504, the web application 68 divides the body of text 400 into portions of text 402 in response to receiving the initial web request 312-2. The web application 68 sizes the text portions 402 so that they will be suitable for inclusion in a network request 316 (see FIG. 2). For example, the network request 316 includes a URL, as shown by sample URL's 412 in FIG. 3. If the request 316 is a HTTP GET request, then the size of the resource identifier 412 including a text portion should be no more than, for example, 100 characters, in one embodiment.

In step 506, the web application 68 provides an output 314 (see FIG. 2) that includes resource identifiers 412 (e.g. URL's) that can be used in converting the text portions 402 from text to speech. Each resource identifier 412 includes one of the text portions 402 and the identity of a resource (e.g. HTTP address) that can be used in converting the text portion 402 into an audio format (see FIG. 3). For example, the web application 68 provides an HTML page 314 including URL's 412 to the browser 308. The browser 308 can then make text portion web requests (e.g. HTTP requests) 316 to a TTS server 302 based on the URL's provided in the HTML page 314. The TTS server 302 provides the text-to-speech conversion and then responds to the requests 316, as described below for FIG. 5.

Figure 5:
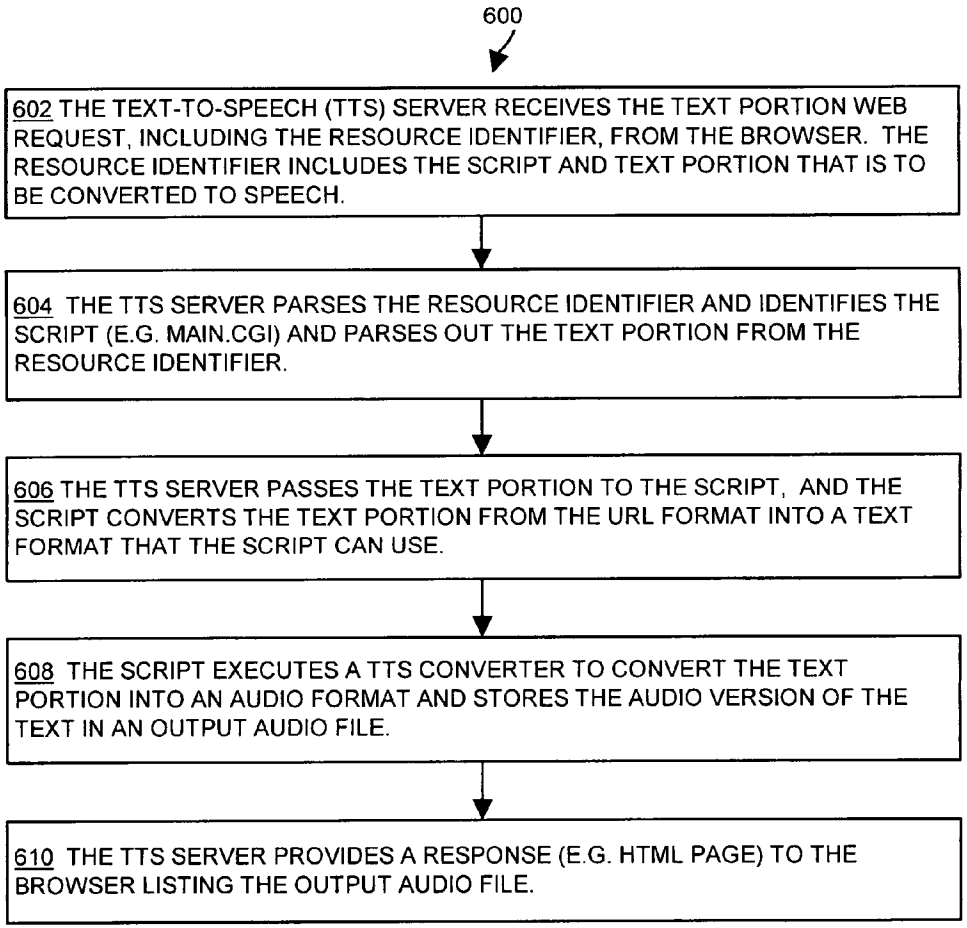
FIG. 5 is a flow chart of the process of converting a text portion to an audio output file according to one embodiment of the invention.

FIG. 5 is a flow chart of the process 600 of converting a text portion 402 to an audio output file 318 according to one embodiment of the invention. In step 602, the TTS server 302 receives the text portion web request 316, including a resource identifier, from the browser 308 (see FIG. 2). In one embodiment, the resource identifier 412 includes a reference to a script 422 and the text portion 424 to be converted to speech, as described for FIG. 3. For example, the browser 308 sends an HTTP request 316 including one of the URL's 412 from an output HTML page 314 including a list of the URL's 412-1, 412-2, 412-3, 412-4. The application server 66 provides the URL's 412 in the output HTML page 314 in a sequence such that the text portions 424 in the URL's 412-1, 412-2, 412-3, 412-4 represent the respective positions of the text portions, 402-1, 402-2, 402-3, and 402-4, in the body of text 400. The browser 308 then sends the URL's 412 in the same sequence (i.e. 412-1, 412-2, 412-3, 412-4) to the TTS server 302 as a sequence of text portion web requests 316, so that the browser 308 can use the responses 318 (e.g. audio output files) to provide audio output 320 that represents the text portions 402-1, 402-2, 402-3, 402-4 in their respective positions in the body of text 400. In effect, the user of the client device 310 hears all of the body of text 400 typically without noticeable delay.

In step 604, the TTS server 302 parses the resource identifier 412 and identifies the script 422 (e.g. MAIN.CGI) and parses out the text portion 424 from the resource identifier 412.

In step 606, the TTS server 302 passes the text portion 424 to the script 422 and the script 422 converts the text portion 424 from the URL format into a text format that the script 422 can use. For example, the TTS server 302 removes the plus signs (+) and other delimiters from the character string that makes up the text portion 424 to produce a reformatted text portion that the TTS server 302 provides as input to the script 422.

In step 608, the script 422 executes a TTS converter to convert the reformatted text portion into an audio format (such as a WAV audio file format) and stores the audio version of the reformatted text portion in an audio output file 318 (e.g. WAV file).

In step 610, the TTS server 302 provides a response 318 (e.g. HTML page) to the browser 308 listing the audio output file produced in step 608. The browser 308 then references the audio output file to provide an audio output 320 (e.g. electrical or other signals based on the audio output file provided in the response 318) to the client device 310, which plays the audio output 320 on a speaker associated with the client device 310 for the user of the client 310.

Figure 6:
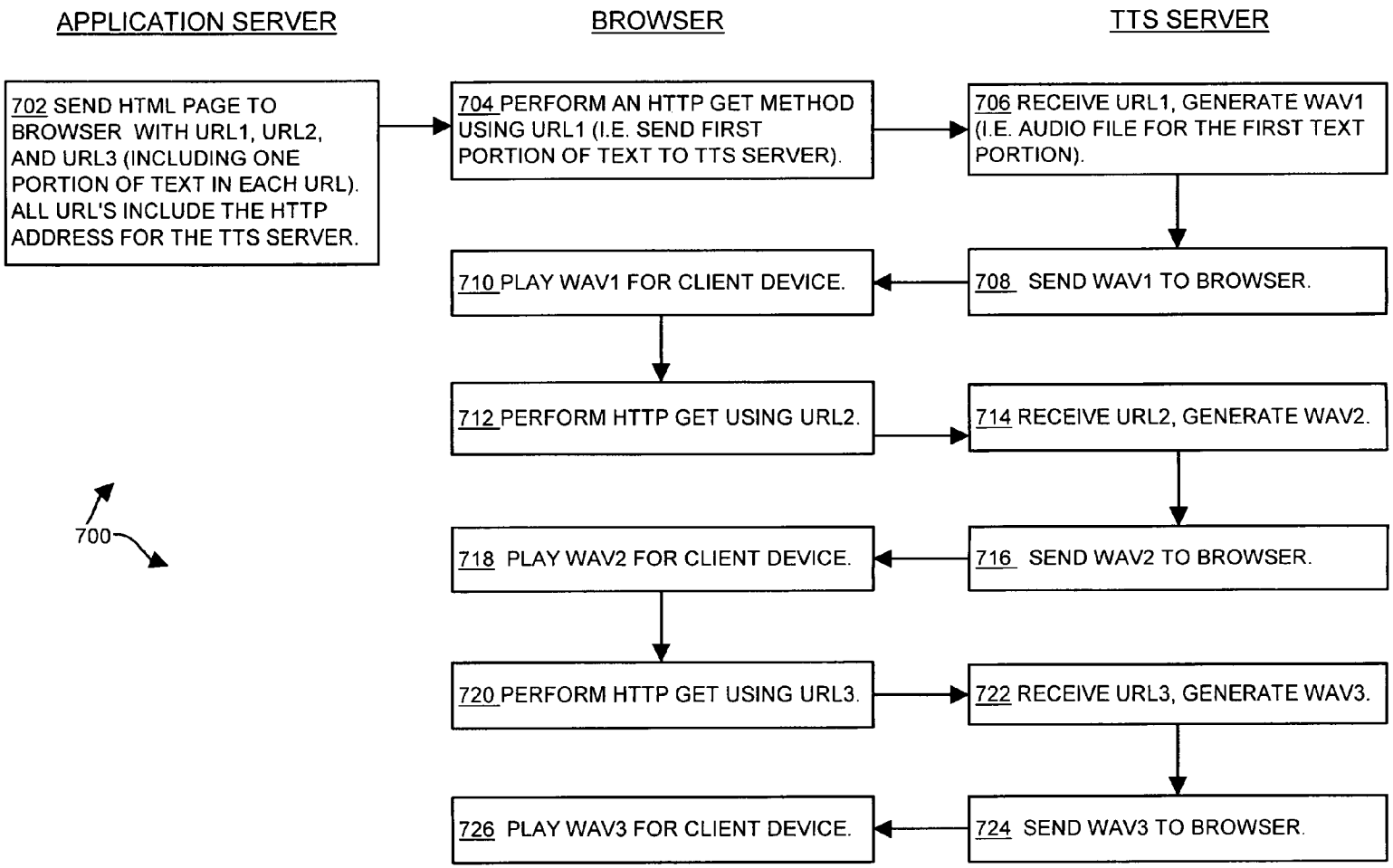
FIG. 6 is a flow chart of the process of requesting and playing audio output files representing text portions according to one embodiment of the invention.

FIG. 6 is a flow chart of the process 700 of requesting and playing audio files by the browser 308 from the application server 66 and TTS server 302, for one embodiment of the invention. In step 702 the application server 66 sends the HTML page 314 to the browser 308. The HTML page 314 lists URL1, ULR2, and ULR3 (see e.g. URL 412 in FIG. 3). URL1, URL2, and URL3 each include an HTTP address (see e.g. 420 in FIG. 3) for the TTS server 302 and one text portion (see e.g. 424 in FIG. 3).

In step 704, the browser 308 performs an HTTP GET request 316 using URL1 (see e.g. 412-1 in FIG. 3) to the TTS server 302 to send the first portion of text (e.g. 402-1) to the TTS server 302 and request its conversion to audio format. In step 706, the TTS server 302 receives URL1 and generates an audio format file (e.g. WAV1) representing the first text portion (e.g. 402-1). In step 708, the TTS server 302 sends the audio format file WAV 1 as a response 318 to the browser 308. In step 710, the browser 308 plays WAV1 for the client device 310 (i.e. sends electrical or other signal representing the WAV1 file to the client device 310 which the client device 310 outputs as audio output 320 through a speaker) so that the user of the client device 310 hears audio output 320 representing the first text portion (e.g. 402-1).

In step 712, the browser 308 performs an HTTP GET request 316 using URL2 (e.g. 412-2) to the TTS server 302 to send the second portion of text (e.g. 402-2) to the TTS server 302 and request its conversion to audio format. In step 714, the TTS server 302 receives URL2 and generates an audio format file (e.g. WAV2) representing the second text portion (e.g. 402-2). In step 716, the TTS server 302 sends the audio format file WAV2 as a response 318 to the browser 308. In step 718, the browser 308 plays WAV2 for the client device 310 so that the user of the client device 310 hears audio output 320 representing the second text portion (e.g. 402-2).

In step 720, the browser 308 performs an HTTP GET request 316 using URL3 (e.g. 412-3) to the TTS server 302 to send the third portion of text (e.g. 402-3) to the TTS server 302 and request its conversion to audio format. In step 722, the TTS server 302 receives URL3 and generates an audio format file (e.g. WAV3) representing the third text portion (e.g. 402-3). In step 724, the TTS server 302 sends the audio format file WAV3 as a response 318 to the browser 308. In step 718, the browser 308 plays WAV3 for the client device 310 so that the user of the client device 310 hears audio output 320 representing the third text portion (e.g. 402-3).

If the application server 66 provided additional URL's in the output 314, then the process 700 described for FIG. 6 continues until all the text portions 402 represented in the URL's 412 have been played, and the user of the client device 310 hears the entire body of text 400.

Alternately, each URL (e.g., URL1, URL2, URL3) is referenced by the browser 308 in parallel. The TTS server 302 then handles the URL processing (i.e., TTS conversion) concurrently and returns the audio-based output to the browser 308 in a predetermined order. In another alternative, while the browser 308 plays one audio output file based on one URL (e.g., URL1), the browser 308 sends the next URL (e.g., URL2) to the TTS server 302.

While this invention has been particularly shown and described with references to preferred embodiments thereof, it will be understood by those skilled in the art that various changes in form and details may be made therein without departing from the spirit and scope of the invention as defined by the appended claims.

For example, the approach of the invention does not require the IP network 50 illustrated in FIG. 1 to be based only on the IP (Internet Protocol) but can be based on other network protocols, or communication arrangements among computing and other types of devices, allowing for the sending and receiving of requests among the devices. Similarly, the approach of the invention does not require the requests to be web requests, IP requests, or HTTP requests, but can be other types of requests communicated over a network or connections among computing and other types of devices.

In one embodiment, the web server 64 and application server 66 can be both implemented on one server computer system. In addition, the application server 66 and TTS server 302 can be implemented on one server computer system. In general, the functions of the web server 64, application server 66, and TTS server 302 can be implemented on one or more computing systems in a distributed computing model, such as a distributed object approach.

In addition, the client 310 and browser 308 arrangement of FIG. 2 is not required by the invention. For example, the client 310 can communicate directly with the application server 66 and the TTS server 68. As a further example, a user can provide input directly (e.g. sit at and type in input) to a browser 308 (e.g. computing device including its own web browser) and hear the audio output 320 through a speaker associated with the browser 308 without the involvement of any separate client device 310.

What is claimed is:

1. A system for providing text-to-speech conversion of a body of text, the system comprising:

a first executable resource; and a second executable resource, wherein:

the first executable resource generates text portions from the body of text in response to receiving an initial web request to convert the body of text to speech;

the first executable resource provides an output in response to generating the text portions, the output comprising a sequence of resource identifiers for the text-to-speech conversion of the text portions, each of the resource identifiers comprising a corresponding one of the text portions and an identity of a resource for use in performing the text-to-speech conversion;

the second executable resource receives a text portion web request that requests the conversion of at least one text portion to an audio format, the text portion web request comprising the at least one text portion and one of the resource identifiers;

the second executable resource provides at least one media file for audio output based on the text portion web request; and wherein the first executable resource generates text portions from the body of text by dividing the body of the text into the text portions, and the output of the first executable resource is a sequences of uniform resource locators for each text portion, the uniform resource locator comprising a name of a resource for converting text-to-speech and the words of a divided text portion separated by delimiters.

2. The system of claim 1, wherein:

the first executable resource generates the text portions in response to receiving an initial hypertext transport protocol (HTTP) request to convert the body of text to speech;

the first executable resource provides a hypertext markup language (HTML) page comprising uniform resource locators (URL's), wherein each URL comprises a text character string for conversion to the audio format and an HTTP address of the resource; and the second executable resource receives at least one HTTP request comprising at least one of the URL's.

3. A method for providing text-to-speech conversion of a body of text, the method comprising the steps of:

generating text portions from the body of text in response to receiving an initial web request to convert the body of text to speech;

providing an output in response to generating the text portions, the output comprising a sequence of resource identifiers for the text-to-speech conversion of the text portions, each of the resource identifiers comprising a corresponding one of the text portions and an identity of a resource for use in performing the text-to-speech conversion;

receiving a text portion web request that requests the conversion of at least one text portion to an audio format, the text portion web request comprising the at least text portion and one of the resource identifiers in response to the step of providing the output;

providing at least one media file for audio output in response to the step of receiving the text portion web request; and wherein the generating text portions from the body of text is performed by dividing the body of the text into the text portions, and the output of the first executable resource is a sequences of uniform resource locators for each text portion, the uniform resource locator comprising a name of a resource for converting text-to-speech and the words of a divided text portion separated by delimiters.

4. The method of claim 3, wherein the step of generating text portions comprises generating text portions in response to receiving an initial hypertext transport protocol (HTTP) request to convert the body of text to speech;

the step of providing the output comprises providing a hypertext markup language (HTML) page comprising uniform resource locators (URL's), each URL comprising a text character string for conversion to the audio format and an HTTP address of the resource; and the step of receiving the text portion web request comprises receiving at least one HTTP request comprising at least one of the URL's in response to the step of providing the output.

* * * * *